United States Patent [19]

Bouchard et al.

[11] Patent Number: 4,907,376

[45] Date of Patent: Mar. 13, 1990

[54] PLATE MOUNTED GRINDING WHEEL

[75] Inventors: William L. Bouchard, Washington; Charles W. Sudol; Keith E. Wing, Sr., both of Hillsboro, all of N.H.

[73] Assignee: Norton Company, Worcester, Mass.

[21] Appl. No.: 258,422

[22] Filed: Oct. 17, 1988

Related U.S. Application Data

[63] Continuation-in-part of Ser. No. 192,423, May 10, 1988, abandoned.

[51] Int. Cl.[4] ..... B24D 7/14

[52] U.S. Cl. ..... 51/209 R; 51/207; 51/168

[58] Field of Search ..... 51/209 R, 209 D, 209 L, 51/209 S, 206 R, 206 NF, 207 R, 168, 376, 293, 297, 298, 401

[56] References Cited

U.S. PATENT DOCUMENTS

| | | | |
|---|---|---|---|
| 1,964,539 | 6/1934 | Shue | 51/209 R |
| 2,118,409 | 5/1938 | Loewy | 51/209 R |
| 2,246,223 | 6/1941 | Shue | 51/209 R |
| 2,418,883 | 4/1947 | Homeyer | 51/209 R |
| 2,479,078 | 8/1949 | Milligan et al. | 51/209 R |
| 2,836,017 | 5/1958 | Tygh | 51/209 |
| 3,069,817 | 12/1962 | Kohn | 51/209 R |
| 3,576,090 | 4/1971 | Shoemaker | 51/209 |
| 3,898,773 | 8/1975 | Bogush | 51/206 NF |
| 4,240,230 | 12/1980 | Ferrantini | 51/168 |
| 4,507,897 | 4/1985 | Vieau et al. | 51/209 |

FOREIGN PATENT DOCUMENTS

| | | | |
|---|---|---|---|
| 1045842 | 12/1958 | Fed. Rep. of Germany | 51/209 R |

*Primary Examiner*—Robert Rose

*Attorney, Agent, or Firm*—Arthur A. Loiselle, Jr.

[57] ABSTRACT

A grinding device is disclosed which is particularly suited for grinding railroad tracks. The device is made up of back plate attached to a grinding wheel which is in turn attached to a grinding machine by way of a spindle. The surface of the plate which makes contact with the grinding wheel contains at least two lugs and at least two bolt holes pass through the plate. The lugs on the plate mate with correspondingly shaped depressions or indentations in the side surface of the wheel which contacts the plate and threaded nuts molded in the wheel line up with the bolt holes in the plates and bolts passed therethrough keep the two parts together.

12 Claims, 1 Drawing Sheet

PLATE MOUNTED GRINDING WHEEL

This is a continuation-in-part application of original application Ser. No. 07/192/423 filed May 10, 1988 now abandoned.

TECHNICAL FIELD

The invention relates to plate mounted grinding wheels and more specifically to grinding wheels used on a side surface and held on the opposite side surface to a wheel driving means.

BACKGROUND AND INFORMATION DISCLOSURE STATEMENT

The following United States Letters Patents are representative of the most relevant prior art known to the applicants at the time of filing the application.

| | | |
|---|---|---|
| 2,836,017 | May 27, 1958 | R. L. Tygh |
| 3,576,090 | April 27, 1981 | F. O. Shoemaker |
| 4,240,230 | December 23, 1980 | S. Ferrantini |
| 4,507,897 | April 2, 1985 | R. G. Vieau |

There are types of grinding wheels which grind on a side surface rather than on the periphery, which is the more usual way to use a grinding wheel. Commonly used wheels of this type are the depressed center wheel of U.S. Pat. No. 4,240,230, the disc wheel of U.S. Pat. No. 3,576,090 and the cylinder wheel of U.S. Pat. No. 4,507,897. The characteristic that all three types of wheels have in common is that they all utilize a rather complicated means of attaching the wheel to the driving means. It is this type of wheel and mounting or attaching means that is the subject matter of the present application.

U.S. Pat. No. 3,576,090, so far as it is relevant to the present invention, disclosures a composite disc wheel 2 made up of a bottom grinding section 4 containing useable abrasive and a back section 6 containing nonabrasive particles or a nonuseable layer of abrasive as it is referred to in the patent. The abrasive in the abrasive section 4 and the nonabrasive particles are bonded with a conventional grinding wheel bonding agent. Molded into the nonuseable layer 6 are several threaded bolts 8 and washers 10. The wheel 2 is attached to a supporting and driving plate 12 through bolts 14 which pass through holes in plate and are screwed into the threaded nuts 8. The plate 12 includes a shaft, which is not numbered. The shaft is connected to a motor, either directly or a pulley and belt, which rotates the wheel and plate assembly. The driving force of the plate 12 is conveyed to the wheel solely through the bolts 14 and nuts 8. U.S. Pat. No. 2,836,017 relates to a type of grinding wheel similar to that of U.S. Pat. No. 3,576,090 i.e. a disc wheel. Attachment inserts 3 are molded into the back face of the wheel, each insert comprising a substantially flat web portion 5 including a pair of edge flanges 7 along opposite longitudinal sides of said web portion 5. Both flanges 7 are located on the same side of the plane of web portion 5 and consist of generally perpendicular parts 9 adjacent to the web 5 followed by outwardly inclined parts 11 terminating in the edges 13 which are spaced apart a distance which is greater than the width of the web 5. To facilitate attachment to the driving plate of a grinding machine, the web 5 contains a centrally located hole 15 with a boss 17 on the same side of the web 5 as the flanges 7. Boss 17 is fitted snuggly between the perpendicular parts 9 and for that purpose is provided a pair of parallel edges 19 which are perpendicular to the web 5. Boss 17 includes a threaded opening 21 in registry with the hole 15. It is through the threaded openings and mating bolts that the disc wheel is attached to the driving plate and the entire driving force is imposed on the wheel through the combination of the bolts and attachment element made up of insert 3 molded into the wheel.

U.S. Pat. No.l 4,240,230 to Ferrantini relates to a so-called depressed center wheel in combination with an adapter for attaching the wheel to the shaft of a grinding machine which is usually a portable or hand held grinder. The adapter, which also drives the wheel, is made up of a disc portion 17 which extends axially from a mandrel 11 and has a convex face 19 and a concave face 21. The concave face 21 has a flat flange 23 which extends around the periphery. The flange 23 and ribs 29 make contact with the wheel 25. The flange 23 contains a number of protrusions 27 or bosses which mate with depressions or orifices in the wheel 25. It is the friction between the adapter, and the protrusions 27 on the flange 23 imbedded in the depressions in the wheel 25 that carries the driving force from the grinding machine to the wheel.

Another type of wheel and mounting and driving means is shown in U.S. Pat. No. 4,507,897. In one embodiment of the invention disclosed in the patent a grinding wheel 14, referring to FIGS. 1–5, is molded onto a back plate 11 which has an upper flange 12 and a downwardly directed flange 13. The backing plate 11 has a number of notches 15 in its upper flange 12 which line up with corresponding threaded holes 16 in the outer wall 17 of the back plate holder 18. The back plate 11 is attached to the back plate holder 18 by bolts 19 which pass through the notches 15 and into threaded holes 16. Protruding from the back plate 11 in a downward direction are tabs 21 which are imbedded in the grinding wheel. The tabs transmit the rotation driving force to the grinding wheel 14.

DISCLOSURE OF THE INVENTION

The invention is a disc or cylinder type grinding wheel, i.e. one which grinds on a side surface rather than on the peripheral surface and a special mounting plate for holding and driving the wheel. The wheel is an improvement over the prior art in that at least two threaded nuts and at least two depressions are molded into the upper side surface of the wheel. The threaded nuts serve to attach the wheel to the special driving plate which is attached to a grinding machine, and to drive the wheel in rotating manner. The rotational driving force is further conveyed to the wheel through the depressions in the wheel which mate with lugs on the driving plate. The mounting and driving plate may be made of any material with suitable strength to hold and drive the wheel without breaking. The preferred materials for the plate are steel, iron and aluminum with the latter being most preferred.

The wheel, in its most preferred embodiment, is composed of two sections, an upper and a lower section. The lower section is the section that does the grinding and contains abrasive particles having a Mohs hardness of at least 8 and a vitrified or organic polymer bond for the abrasive grains. The upper section, which should vary in thickness of from 0.25 to 1.5 inch, is made up of particulate material that is less abrasive than the abrasive grains in said lower section, or if the same material, the particles in the upper section should be substantially finer than the abrasive grain in the lower section. The particles in the upper section may be bonded with the same vitrified or organic polymer based bond that is used in the lower or abrasive containing section. As mentioned above, the upper section contains threaded nuts and depressions which are molded into the wheel. The nuts are of the conventional type already known in the art. The molded in depressions can be of any size or shape but should be at least about 0.06 inch deep. While solid lugs protruding from the mating surface of the driving plate are preferred, the lugs may take the form of tabs, two to a lug, which will match the depressions in the wheel.

However, the invention wheel need not be made up of two sections or zones as above described. Rather it may be uniform in composition throughout its thickness. Useable abrasive particles with a Mohs hardness of at least 8 bonded with the same material, vitrified or organic polymer based, may be used throughout the thickness of the wheel so that the aforementioned molded-in nuts and depressions are surrounded by relatively coarse grit useable abrasive grain. The obvious disadvantage to this embodiment of the invention, is the wasting of premium priced abrasive in the non-useable upper side section of the wheel, in which the nuts and depressions are located.

Any abrasive grain can be employed in the lower or grinding section (or the entire thickness of the wheel in the case where the composition of the wheel is uniform throughout) so long as it has a Mohs hardness of at least 8, as pointed out above. However, the preferred abrasive is one selected from the group consisting of silicon carbide, fused alumina, cofused alumina-zirconia, sintered alumina such as that described in U.S. Pat. No. 4,623,364, cosintered alumina-zirconia, cubic boron nitride, diamond, and mixtures thereof. The abrasive grain can have a particle size of from 100 to 4000 microns. The bond for the abrasive grain may be any vitrified bond or any organic polymer based bond such as phenol-formaldehyde, polyester, epoxy, urethane, polybenzimidazole and the like. The bonds may also include any of the fillers and grinding aids known in the art that are amendable with the two types of bonds.

The upper section, if there is one, can be made up of any of a large number of particulate materials so long as they are less abrasive or finer in particle size than the abrasive grain in the lower section of the grinding wheel, including glass fibers, organic fibers, crushed nut shells, hard wood chips, and mixtures of these materials where the bond therefor is an organic polymer bond. Also suitable are metal powders such as steel, iron, copper, aluminum and mixtures thereof. When the bond is of the vitrified type the preferred particulate material for the upper section is kyanite, wollastonite, mullite, garnet, quartz, fluorite, mica, nephaline syenite, barium sulfate, calcium carbonate, and of course any mixture or combination of these materials as well as finely particulate abrasive grain. Obviously, these particulate materials may be utilized with organic polymer based bonds as well. The average particle of this material in the upper section 12 may be from 44 to 4000 microns.

Finally, the abrasive grain and bond contained in the lower section and the particles and bond contained in the upper section may have the following volume percent composition in order to produce a grinding wheel with adequate physical strength and grinding properties:

| | |
|---|---|
| abrasive grain or less abrasive/finer upper section particles | 20–70% |
| resinoid or vitreous bond | 2–60% |
| fine filler and/or grinding aid | 0–50% |
| porosity | 0–60% |

DESCRIPTION OF THE PREFERRED EMBODIMENTS

Figure 1:
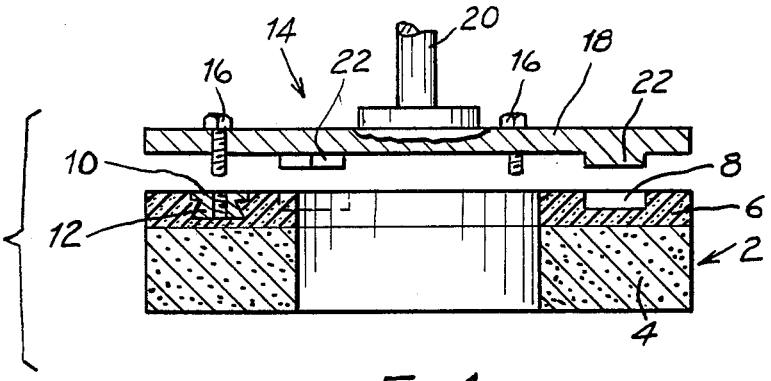
FIG. 1 is a sectional view through a wheel according to the present invention and the driving means which is used to drive or rotate the wheel.
Figure 2:
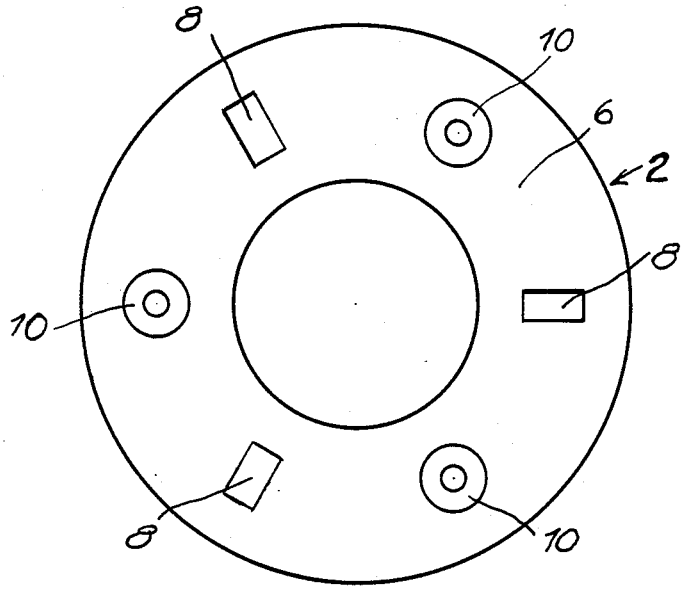
FIG. 2 is a planar view of the top of the wheel showing nuts or bushings and depressions contained in the upper section of the wheel.

A preferred embodiment of the present invention is shown in the FIGS. 1 and 2 of the drawing.

FIG. 1 shows the invention wheel 2 made up of a upper section 6 and a lower abrasive containing section 4. The lower section 4 was composed of abrasive grain having an average particle size of 1190 microns, barium sulfate filler, quick lime, furfuraldehyde plasticizer and a cured phenol formaldehyde resin. The upper section 6 was made up of the same materials as the lower section 4 except that the abrasive grain in the lower section 4 was replaced by 250 micron kyanite and 80 micron wollastonite particles. The details of composition of both upper and lower sections are given below. Still referring to FIGS. 1 and 2, the upper section 6 of the wheel 2 includes threaded nuts 12 with washers 10, and depressions 8 which were molded into the upper section 6; preferrably three of each should be present in the upper section 6. Such a wheel 2 required the specially designed driving means 14 with a driving or mounting plate 18 attached to a spindle 20 which in turn was attached to a grinding machine which is not shown. Through holes in the driving plate 18 passed bolts 16 which were screwed into threaded nuts 12 located in the upper section 6 of the wheel 2. The driving plate 18 included on its under surface, lugs or bosses which were essentially the same configuration as the indentations or depressions 22 in the upper section 6 of the wheel 2 which mated when the driving plate 18 was bolted to the upper section 6 of the wheel 2.

A railroad track grinding wheel, according to the most preferred embodiment of the invention, having an outside diameter of 25.9 cm (10.19 inches), an inside diameter of 14.9 cm (5.87 inches) and a thickness of 7.62 cm (3 inches) was made in the following manner:

A 13.6 kg (30 lb) quantity of a conventional grinding wheel mix was prepared in the known manner. The mix, on a weight percent basis, was made up of 58.6% cofused alumina-zirconia abrasive having an average grain size of 1190 microns, 18% fused aluminum oxide abrasive having an average particle size of 1190 microns, 9.7% of commercial powdered 2-stage phenol-formaldehyde resin, 11.9% of barium sulfate filler with an average particle size of about 5 microns, and 1.8% quick lime with an average particle size of about 4 microns; the mix also contained 60 ml of furfuraldehyde per pound of resin which was added to the abrasive grain just prior to addition of the above described bond material i.e. resin, barium sulfate and lime which were prebatched with 131 ml of Carbosota before being added to the furfuraldehyde wetted abrasive grain. 5.98 kg (13.19 lb) of this mix was placed in a steel mold set-up which had an I.D. of 25.9 cm (10.19 inches) fitted with an abor with an O.D. of 14.9 cm (5.87 inches).

9.07 kg (20 lb) of a second mix was made in the same manner as described above except that this mix had a weight percent composition of 74.7% kyanite with an average particle size of 250 microns, 13% powdered 2-stage phenolformaldehyde resin, 10.5% of wollastonite filler with an average particle size of 14 by 80 microns, and 1.8% quick lime; this mix also utilized furfuraldehyde in the amount of 63 cc per pound of resin which had previously been blended with 12 cc of chlorinated paraffin per pound of resin, and 30 cc of nuetral anthacene oil per pound of dry resin. 1.66 kg (3.66 lb) of this mix was placed on top of the first mix in the mold, a special top plate put in place and the contents of the mold pressed to a thickness of 7.68 cm (3.03 inches) at atmospheric temperature. The green wheel was removed from the mold and heat treated for 20 hours with a maximum soak temperature of 185° C. The resulting approximately 7.68 cm (3.03 inches) thick wheel had an upper section measuring approximately 1.9 cm (0.75 inch) thick containing the less abrasive kyanite in place of the usual highly abrasive cofused alumina-zirconia abrasive.

The special top mold plate was special in two respects. First it was magnetized and had location marks on the surface which was to contact the abrasive mix in the mold. The location marks were for the purpose of locating the nuts and washers 10 and 12 respectively, on the plate prior to pressing the nuts into the abrasive mix. The plate also included lugs the same as those shown as 22 on the driving plate 18 of FIG. 1. When the top mold plate carrying the magnetically held nuts and including lugs on the bottom surface, was pressed into the non-abrasive containing upper mix, the nuts were imbedded in the mix thus forming a green wheel as shown in FIGS. 1 and 2 as 10 and 12. The lugs on the bottom surface of the mold plate created indentations or depresions 8 in the green wheel.

What is claimed is:

1. A grinding wheel made up of abrasive grain and a bond therefore, said wheel having a lower side surface and an upper side surface, said wheel being adapted to grind on its lower side surface with said upper side surface being attachable to a wheel mounting plate, wherein the improvement comprises:

an upper section and a lower section, said lower section constituting a grinding section composed of abrasive grain and a bond therefore, said upper section being composed of particles that are selected from the class consisting of particles that are less abrasive and finer in particle size than the abrasive grain in said lower section, and wherein at least two threaded nuts and at least two depressions of substantial radial dimension are molded into the upper section, said threaded nuts being means for attaching said grinding wheel by bolts which pass through the wheel mounting plate, and said depressions being a means for driving the wheel by mating with matching lugs on the wheel mounting plate.

2. The grinding wheel of claim 1 wherein said bond is an organic polymer based bond and may include fillers and grinding aids.

3. The grinding wheel of claim 1 wherein said bond is a vitrified bond and may include fillers and grinding aids.

4. A grinding wheel according to any one of claims 1, 2 or 3 wherein the abrasive grain is selected from the group consisting of sintered alumina, sintered alumina-zirconia, silicon carbide, fused alumina, fused alumina-zirconia, cubic boron nitride, diamond and mixtures thereof.

5. The grinding wheel of claim 1 wherein said wheel has the following volume percent composition:

| | |
|---|---|
| abrasive grain | 20–70 |
| resin or vitrified bond | 2–60 |
| filler | 0–50 |
| porosity | 0–60 |

6. The grinding wheel of claim 1 wherein the particles in said upper section are selected from the group consisting of glass fibers, oganic fibers, crushed nut shells, wood chips and mixtures thereof and said bond is an organic polymer based bond.

7. The grinding wheel of claim 1 wherein said particles in said upper section are selected from the group consisting of steel, iron, copper, aluminum, kyanite, andalusite, wallastonite, mullite, garnet, quartz, fluorite, mica, nephaline syenite, barium sulfate, calcium carbonate, cryolite, sintered alumina, sintered alumina-zirconia, silicon carbide, fused alumina, fused alumina-zirconia, and mixtures thereof.

8. The grinding wheel of claim 7 wherein the bond in said upper and lower sections is an organic polymer based bond.

9. The grinding wheel of claim 7 wherein the bond in said upper and lower sections is a vitreous bond.

10. The grinding wheel of claim 1 wherein the upper section thereof has the following volume percent composition:

| | |
|---|---|
| less abrasive and/or finer particles | 20–70 |
| resin or vitreous bond | 2–60 |
| filler | 0–50 |
| porosity | 0–60 |

and the average particle size of said less abrasive and/or finer particles is from 44 to 4000 microns.

11. The grinding wheel of claim 1 wherein the lower section thereof has the following volume percent composition:

| | |
|---|---|
| abrasive grain | 20–70 |
| Resin or vitrified bond | 2–60 |
| filler | 0–50 |
| porosity | 0–60 |

and the average particle size of said abrasive grain is from 100 to 4000 microns.

12. The grinding wheel according to any one of claims 1, 6, 7, 8, 9, 10 or 11 wherein the abrasive grain in said lower section is one selected from the group consisting of sintered alumina, sintered alumina-zirconia, silicon carbide, fused alumina, fused alumina-zirconia, cubic boron nitride, diamond, and mixtures thereof.

* * * * *